US008116896B2

(12) United States Patent
Ko

(10) Patent No.: US 8,116,896 B2
(45) **Date of Patent: *Feb. 14, 2012**

(54) METHOD FOR CREATING PANELS FOR A GARMENT

(76) Inventor: Young-A Ko, Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 12/870,446

(22) Filed: Aug. 27, 2010

(65) Prior Publication Data

US 2011/0146038 A1 Jun. 23, 2011

Related U.S. Application Data

(60) Provisional application No. 61/289,354, filed on Dec. 22, 2009.

(51) Int. Cl.
*G06F 19/00* (2011.01)

(52) U.S. Cl. ..... 700/132; 700/131

(58) Field of Classification Search ..... 700/130–134; 705/26, 27

See application file for complete search history.

(56) References Cited

U.S. PATENT DOCUMENTS

| | | | | |
|---|---|---|---|---|
| 6,907,310 | B2 * | 6/2005 | Gardner et al. | 700/132 |
| 7,079,134 | B2 * | 7/2006 | Kung et al. | 345/420 |
| 7,409,259 | B2 * | 8/2008 | Reyes Moreno | 700/132 |
| 7,657,340 | B2 * | 2/2010 | Lind | 700/132 |
| 2001/0026272 | A1 * | 10/2001 | Feld et al. | 345/419 |
| 2006/0142891 | A1 * | 6/2006 | Kenji et al. | 700/131 |
| 2009/0019895 | A1 * | 1/2009 | Kawasaki et al. | 700/131 |
| 2009/0099683 | A1 * | 4/2009 | Lastra et al. | 700/132 |
| 2009/0112353 | A1 * | 4/2009 | Kirefu et al. | 700/131 |

* cited by examiner

*Primary Examiner* — Nathan Durham
(74) *Attorney, Agent, or Firm* — John K. Park; Park Law Firm

(57) ABSTRACT

A method for creating panels comprises steps of: defining a horizontal axis on a pattern-making window; defining a vertical axis; defining an outward side on the pattern-making window toward an observer; forming the textile coordinate system defined by the horizontal axis and the vertical axis; providing a first panel; providing a plurality of first pattern-making layers associated with the first panel; visualizing the first panel and at least one of the plurality of first pattern-making layers; and storing the plurality of panel points and lines and the plurality of pattern-making points and lines in a pattern-making computer file.

11 Claims, 5 Drawing Sheets

METHOD FOR CREATING PANELS FOR A GARMENT

RELATED APPLICATION

This application is a Non-provisional application of the provisional patent Application No. 61/289,354 for "Method for Digital Clothing" filed on Dec. 22, 2009.

BACKGROUND OF THE INVENTION

The present invention relates to a method for creating panels for a garment, which is written to introduce how to use the digital clothing technology for clothing design and production or how to create and animate clothes on the computer.

SUMMARY OF THE INVENTION

The present invention contrives to solve the disadvantages of the prior art.

An aspect of the invention is to provide a textile coordinate system for woven cloth.

The method for creating panels for a garment using a textile coordinate system in a digital clothing comprises steps of:

defining a horizontal axis on a pattern-making window;

defining a vertical axis on the pattern-making window;

defining an outward side on the pattern-making window toward an observer in front of the pattern-making window;

forming the textile coordinate system defined by the horizontal axis and the vertical axis on the outward side of the pattern-making window;

providing a first panel comprising a plurality of panel points and lines defined on the textile coordinate system, wherein the plurality of panel points and lines form a closed boundary;

providing a plurality of first pattern-making layers associated with the first panel, each of which comprising a plurality of pattern-making points and lines, wherein the plurality of pattern-making points and lines form a pattern;

visualizing the first panel and at least one of the plurality of first pattern-making layers on the pattern making window; and storing the plurality of panel points and lines and the plurality of pattern-making points and lines in a pattern-making computer file.

The horizontal axis may be along a warp direction of a textile roll. The vertical axis may be along a weft direction of the textile roll.

The method may further comprise a step of providing a first master panel comprising the first panel. The first master panel may further comprise a seam allowance provided around the first panel. The first mater panel may further comprise a plurality of master panel points and lines defining a master panel contour.

The plurality of panel points and lines may form a panel contour.

The method may further comprise steps of:

translating each of the plurality of pattern-making layers on the pattern-making window;

rotating each of the plurality of pattern-making layers on the pattern-making window; and scaling each of the plurality of pattern-making layers on the pattern-making window.

The step of visualizing may comprise steps of:

turning on or off each of the plurality of pattern-making layers on the pattern-making window;

dimming each of the plurality of pattern-making layers on the pattern-making window; and darkening each of the plurality of pattern-making layers on the pattern-making window.

The method may further comprise a step of storing the first panel in a panel computer file.

The method may further comprise a step of providing a second panel comprising a plurality of panel points and lines defined on the textile coordinate system, wherein the plurality of panel points and lines form a closed boundary.

The method may further comprise a step of providing a plurality of second pattern-making layers associated with the second panel, each of which comprising a plurality of pattern-making points and lines, wherein the plurality of pattern-making points and lines form a pattern.

Each of the first and second panel may be configured to represent a cloth piece.

The advantages of the present invention are: (1) the method for creating panels for a garment is for woven cloth; and (2) the method for creating panels for a garment is adapted to be used in methods for digital clothing.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

Figure 1:
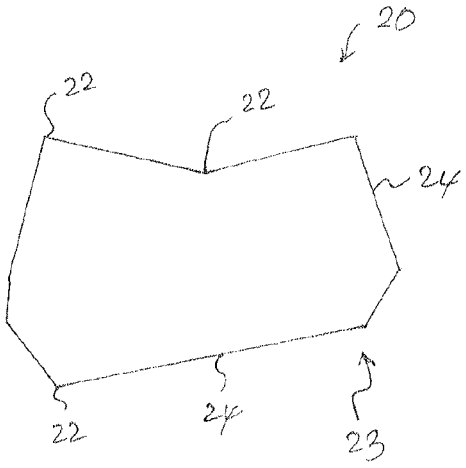
FIG. 1 is a perspective view showing a panel according to an embodiment of the invention.

U.S. Provisional Application No. 61/289,354 was filed on Feb. 9, 2010 for an invention entitled "Method for Digital Clothing." The disclosures of the application are incorporated by reference as if fully set forth herein.

1. Introduction

Among all the technological achievements which have been made throughout human history, if one is asked to pick an item that exerts the most profound effect to today's human life, arguably it would be the invention of computers. Computers have been continuously replacing humans in various kinds of tedious work. Since clothing design and manufacturing involves a large amount of tedious work, a question naturally arises: how much have the computers been relieving clothing people from the tedious work?

At early stages, computers were built for processing numbers and texts. Thus they were suited for scientific calculation or simple business computation, but were not suited for tasks which require complicated human-computer interactions.

Meanwhile, an important innovation was made to computers. It was the development of graphics technology, which stores three dimensional (3D) representation of an object in the memory and visualizes the object from arbitrary vantage points. This new technique, which enabled seeing before making and true human-computer interaction, brought a huge impact to manufacturing industry. The technology initiated so-called computer-aided design/manufacturing (CAD/CAM), which has been settled as a standard methodology in many industrial areas (e.g., automobile production).

Now, let's go back to the original question: how well are the computer technologies exploited in clothing design and manufacturing? Computers are indeed being used in various stages of these days' clothing production. For example, it is commonplace to use a CAD software for creating/editing patterns; textile-design CAD softwares are also becoming popular tools among fashion designers.

However, the level of computerization practiced in clothing production has been far from satisfactory. Even though individual components (pattern editing/cutting, previewing of textiles) have been computerized, in actual clothing production, a significant amount of tedious work still has to be done by human hands. No reliable technology has been generally available which can tell, before sewing the actual panels in the conventional way, the panels you draw on a pattern-CAD window will produce a garment you really want. The clothes you synthesize on a design-CAD window often differ from what you really get.

An essential part which has been missing for a satisfactory computerization of the clothing production process was the interplay between the pattern editing and previewing of the resulting outfit; fashion designers could not see the final look (draping, fabric details, etc.) of the clothes they constructed on the pattern-CAD software. Providing such a feedback can be done in principle if we can predict the static draping or dynamic movements of the CAD-constructed clothes in response to the body posture or motion. But it turns out a difficult problem. Experts in textile/mechanical engineering have been studying this problem for decades.

It is worth to note the breakthroughs made at the beginning of the 21st century in physically-based simulation of cloth. In 2002, so called the immediate buckling model proposed by Choi and Ko brought remarkable improvements in both realism and simulation speed. In the following years, additional improvements have been made in the other aspects of clothing simulation. As a result, complex clothes can now be constructed on a computer, and their dynamic movements can be simulated with a reasonable degree of realism.

The physical simulation of clothes and other necessary components to enable computer-aided clothing design/manufacturing (CACD/CACM) are not fully mature yet. But it is significant to realize that the current technology is already enough to bring revolutionary changes in clothing production. As word processors profoundly changed the writing culture, the above technology can reduce cumbersome work in clothing production to a remarkable level. A new era is coming in which you can produce clothes by designing/editing them on the computer and finally submitting the results to a CACM system. The author of this disclosure believes that now is a good time for a clothing expert to start studying this new technique. We will refer this new branch of study (i.e., creation, previewing, and manufacturing of clothes with a full utilization of the computer technologies) as digital clothing. This disclosure is prepared as a disclosure to introduce digital clothing. This disclosure can bring more vivid experiences if the readers experiment relevant topics using a digital clothing software.

1.1 Goal of Digital Clothing

The goal of digital clothing is to make clothing design and manufacturing easier by making a full utilization of computers. The computer technology has made striking improvements over the past sixty years. Nevertheless, various kinds of cumbersome work still exist in clothing production. A fundamental source of such incumbrance is that clothes can not be previewed/assessed until they are constructed with real fabrics. A critical feature of digital clothing is that it allows the users to preview, assess, and make modifications to the clothes on the computer without constructing real ones. Digital clothing will be connected to a manufacturing hardware in the future, so that the clothes constructed on the computer can be manufactured by just clicking the 'output' icon. With a proper utilization of the digital clothing technology, people can focus more on creative aspect of clothing production, and clothing production cycle can accelerate tremendously.

1.2 Overview of Digital Clothing Process

The most typical usage of the digital clothing technology may take the following process: firstly the user constructs clothes on the computer, then previews the fabric details and draping behavior of the clothes, makes necessary modifications to them, and finally she/he manufactures the result.

In this disclosure we will call the stages involved while working with the digital clothing technology collectively as the digital clothing process. The remainder of this section takes a closer look at the digital clothing process, which consists of the following stages:

Body Preparation
Pattern Making
Garment Construction
Attire Setup
Physical Attribute Specification
Draping Simulation
Textile Design
Rendering
Adding Auxiliary Components Clothing production is targeted to a certain body. Therefore preparation of the body should be the starting point of the digital clothing process. The details of this body preparation stage will be presented below.

For the prepared body, we can now construct clothes. For constructing clothes, a fundamental step would be pattern-making. For pattern-making, various kinds of lines need to be drawn. The details of line drawing are presented later. By selecting a subset of the above lines, we can define panels. Creation of panels is presented later. We can construct a garment by specifying seams between panels. The details of this garment construction stage is presented later. Attire is a collection of garments which are put on the same body. The concept of attire becomes significant when a try-on test (i.e., draping simulation) is to be performed, since most preparations for the try-on test are done while setting up the attire. The details of attire setup are explained below. The physical property (e.g., stretch stiffness) of the fabric used for the garment need to be specified. This task is done in the physical attribute specification stage.

With the physical attributes being set, now draping simulation can be performed to examine the dynamic movements of the clothes while the human character takes a walk. The steps involved in draping simulation is going to be presented later. In addition to the physical attributes of the fabric, the fabric details (e.g., texture, fabric structure) need to be set. This task is done in the fabric detail specification stage. Visualization of the 3D clothes on the computer is called rendering. In order to get desired rendering of the scene, the user need to control the vintage point or the colors/positions of the light sources. The details of this step are presented later. In digital clothing, some auxiliary components such as hair, shoes, accessories can be added to the result of the above.

If the result of the try-on test is not satisfactory, the user can go back to a relevant stage and make necessary modifications, and perform the try-on test again. This loop can repeat until the user obtains a satisfactory result. Then, the user can finally manufacture the result.

1.3 Goal of a Digital Clothing Course

The goal of a digital clothing course (offered in a university) could be set to teach how to design and manufacture clothes with computers. The course can let the students experience that the components which used to be done in the conventional way can be done on the computer, that their clothing design can be stored/modified, that their result of design can be previewed with a photo-realistic quality and manufactured on any machine in the world as long as they can find a machine supporting it.

Most students majoring in clothing are not familiar with working on 3D scenes. The author notes that it is worth while to take some time/effort to become familiar with the manipulation of 3D scenes, since it will lead to innovations the digital clothing technology can readily provide.

1.4 Goal

The goal is to disclose at least one aspect of digital clothing courses. This disclosure teaches how to construct clothes on the computer, how to perform try-on tests, how to preview and manufacture digitally generated clothes.

In the process of delivering the above, this disclosure attempts to establish some terminologies which might facilitate the digital clothing study. In contrast to the conventional clothing, in digital clothing, you instruct the computer to do the job. For precise human-computer communication, digital clothing often needs to have terminologies which refer to very detailed/specific features. For example, when creating a dart, the user may want to equalize the dart legs, the meaning of which will be introduced in a subsequent chapter. Establishment of terminologies for human-computer communication might also contribute to facilitating human-human communication.

1.5 Differences from a Manual

The heart of digital clothing is doing it with computers. This disclosure has a practical goal of teaching the readers how to perform the clothing design/production steps on the computers. Then, how is this disclosure different from the manual of a digital clothing software? Digital clothing does not have a great deal of theoretical aspects, but it does contain some abstract and fundamental elements. Education of abstract/fundamental elements is contrasted from practicing a software in that the former needs to explain the why parts which are usually not included in manuals. Certain parts of digital clothing process are not intuitive when compared with the conventional clothing production process. For example, digital clothing elaborates on collision handling. Readers may feel curious why they have to be aware of collisions in dealing with clothes. This disclosure explains the state-of-the-art digital clothing program spends 70% of its computation on collision handling, and the program can spend a lot more unless the user provides some kind of hints about the current colliding/contact situation between body and garment or garment and garment. The organization of this disclosure follows the general clothing production process rather than the software menu structure. The disclosure does not attempt to explain all the menu items or keyboard functions. The disclosure rather looks like a conventional clothing construction disclosure except that it is augmented with how to do it with computers.

1.6 Scope of This disclosure

The current edition of this disclosure will be mostly about CACD, with a very limited coverage of CACM. The main reason of this unbalanced coverage is because CACM is still on its way. When CACM becomes available, a new edition of this disclosure will be prepared to accommodate the updates.

1.7 Organization of This disclosure

This disclosure can be viewed as consisting of five parts. It is a logical structure; the chapters constituting a part do not necessarily come consecutively. The content of each part is summarized below:

Constructing/Measuring Bodies: This part presents how to create a desired body and how to take measurements from a given body.

Constructing Clothes: This part presents how to construct clothes on the computer. The process is similar to conventional off-line clothing construction. The first thing you should do is to prepare the panels. Then you have to tell how the panels should be sewed together. For a clothing expert, basic flow of the process should be intuitively understandable. We note that in digital clothing there exists another way of constructing clothes; it is by directly modeling the 3D shape of the (parts of) clothes when they are put on a body. This approach is particularly useful for the inclusion of decorative pieces (e.g. a flower made of ribbons). The practical value of this direct 3D modeling approach in the context of clothing production is questionable, but the approach can be a useful measure for communication among clothing experts. (This disclosure will not discuss this approach any further.)

Setting up the Physical and Fabric Details: This part is about controlling the fabric structures and physical parameters (e.g., the tensile stiffness, mass density), which are essential for making the results of digital clothing related to real clothes.

Draping Simulation: This part presents you how the draping of the garments can be simulated. Readers will find this part the magic of the digital clothing technology. But it is also this part that may bring you frustrating experiences if you don't do it properly.

Rendering: This part is about synthesizing an image or a sequence of images. To obtain a desired image, you may need to control the light source, camera angle, etc. The visual quality of the rendering usually trades-off with the computation time. The readers may need to build some experience in rendering to be able to create desired visual impression of her/his design work.

2. Body Preparation and Measurements

All the clothing production steps are targeted to a certain body. Therefore the capability to generate a body which suits to your own purpose and/or take measurements from a given 3D body is a natural thing to master at the beginning of a digital clothing course. This chapter is about creation and measurement of human bodies. 3D scan is becoming generally available and is clearly a way of obtaining human bodies. But for the moment scanned bodies are not directly useable for try-on test. A critical reason is because the scanned body is not segmented into articulated parts so that joints can be bent. The current version of this disclosure does not discuss scanned bodies. But as the digital clothing technology can embrace scanned bodies, updates will be made to this disclosure in the future to cover the scanned bodies.

Description on creation/measurement of a human body inevitably entails some ground knowledge on human anatomy and anthropometry. With an intention to become a self-contained disclosure, this chapter starts with introductory materials including the body landmarks, landmark lines, and primary body measurements. Then, the chapter will come back to the main topics, i.e., creation/measurement of a human body. The readers, who are not going to take any body measurements or the readers who are not going to generate any novel bodies but will simply use one of the bodies provided by DC-SUITE may skip some parts of this chapter.

The materials presented in this chapter refers various landmarks, landmark lines, and circumferences in the body, the names of which turn out easier to memorize when we comprehend a few basic terminologies for anatomical planes and directions:

Anatomical Planes (In human anatomy, three (imaginary) anatomical planes are in use, each of which divides the body into two sections.)

The sagittal plane splits the body vertically into left and right sections.

The coronal (or frontal) plane splits the body vertically into front and back sections.

The transverse plane splits the body into top and bottom sections.

Directional Terms (In human anatomy, several directional terms (or prefixes) are in use to indicate the position/direction within the body.)

Superior/Inferior: These two terms are used to mean that something is closer/farther to/from the head. Superior and inferior are complete words; their prefix forms are supra- and infra-, respectively. For example, patella is the kneecap. The superior patella (or suprapatella) is the topmost point of the patella, while the inferior patella (or infrapatella) is the bottommost point of the patella.

Anterior/Posterior: These two terms are used to mean that something is in the front/back of the body. For example, the anterior/posterior waist is the frontal/rear center at the level of the waist.

Medial/Lateral: These two terms are used to mean that something is toward/away from the mid-axis of the body. For example, the medial/lateral malleolus is the inward/outward protrusion at the ankle.

Proximal/Distal: These two terms are used to mean that something is closer/away to/from the trunk. For example, the proximal/distal extreme of the lower leg are the knee/ankle.

This chapter starts with the study of body landmarks and landmarklines, and introduces how primary body measurements are taken. Then, it explains how various measurements in general can be taken from a given body. Finally, the chapter presents how a desired body can be created.

2.1 Body Landmarks

Body landmarks (BLs) mark the key locations on the surface of the body, which play an essential role in the measurement and creation of a body. The ability to identify the location of each landmark as well as to memorize its name can facilitate professional communications regarding human body.

Several groups of researchers attempted to standardize body landmarks. Unfortunately there isn't yet a single set of landmarks which is accepted as standard throughout the world. The lack of standardization can cause inconvenience in the use as well as in the development of a digital clothing software; a software which cover a set of BLs may not cover a few BLs which are adopted by the current users.

We note that we can take the union of the landmark sets proposed so far, so that the result may contain any landmarks which can possibly arise in the study of body. We will call such comprehensive set of body landmarks as the BL-superset. What DC-SUITE attempts in order to circumvent the above inconvenience is to let the body have all the landmarks in the BL-superset, so that any practical BL-set can be covered. With this provision, the user can freely have his own set of BLs, as long as those BLs are included in the BL-superset. In a DC-SUITE body, BLs are already marked (by a body expert). When the user creates a novel body by transforming an existing DC-SUITE body, the BLs undergo the same transformation. DC-SUITE provides an additional user interface so that the user can make further modifications to the location of the BLs if needed.

The main purpose of this section is to list the BL-superset and then provide necessary explanations/drawings so that the readers can locate each BL. Standardizing the names is a daunting task. What this disclosure do is to follow ISO standard whenever possible, and list the synonyms to facilitate the identification of the Bls. DC-SUITE allows the user to rename a BL. Therefore, as long as the BL-superset includes all the desired BLs, the user can define his own set of BLs with his own naming. Although the explanations/drawings given in this section will suffice in most cases, the readers are encouraged to refer to additional literature when it is needed.

2.1.1 Body Landmarks in the Head and Neck

Vertex (=Crown): The highest point on the head when the head is in the Frankfort plane.

Glabella: The anterior point on the frontal bone midway between the bony brow ridges.

Sellion: The point of the deepest depression of the nasal bones at the top of the nose.

Occiput: The anatomical term for the posterior (back) portion of the head.

Inion: The most prominent projection of the occipital bone at the lower rear part of the skull.

Tragion: The superior point on the juncture of the cartilaginous flap of the ear with the head.

Menton: The inferior point of the mandible in the sagittal plane.

Inferior Thyroid (=Adam's Apple=Infrathyroid): The inferior point in the midsagittal plane of the thyroid cartilage.

Lateral Neck: The intersection of the neck base line and the front edge of the 'Deung-Se-Mo-Geun'.

Anterior Neck: The intersection of the neck base line and the center front line.

Cervicale (=7th Cervical Vertebra): The superior palpable point of the spine of the seventh cervical vertebra.

2.1.2 Body Landmarks in the Shoulder

Acromion (=Shoudler Point): The point of intersection of the lateral border of the acromial process and a line running down the middle of the shoulder from the neck to the tip of the shoulder.

Lateral Shoulder (=Shoulder Joint): The intersection of the armscye circumference and the vertical line which, when viewed from the side, divides the upper arm into two equal thicknesses.

Midshoulder (=Collarbone Point=Clavical Point): The point in the middle of the line between the lateral neck and the acromion.

Mesosternal: The point on the union of the third and fourth sternebrae.

Suprasternal (=Top of Breastbone): Bottom most (inferior) point of the jugular notch of the breastbone (sternum).

Posterior Axilla (=Back-Break Point): A diagonal line connecting the apex of the posterior axillary fold with the acromion landmark on the tip of the shoulder.

Anterior Axilla (=Front-Break Point): A short horizontal line on the upper arm originating at the apex of the right anterior axillary fold.

Axilla (=Armpit): Points at the lower (inferior) edge determined by placing a straight edge horizontally and as high as possible into the armpit without compressing the skin and marking the front and rear points or the hollow part under the arm at the shoulder.

Posterior Midaxilla: A short horizontal line bisecting the posterior diagonal scye landmark.

Anterior Midaxilla: A short horizontal line bisecting the anterior diagonal scye landmark.

Axillary Level at Midspine: Level of the axilla marked on the spine.

2.1.3 Body Landmarks in the Torso

Nipple (=Bust Point): The anterior points of the bra cups.

Inferior Breast: The inferior point of the juncture of the lower of the two breasts with the torso.

Tenth Rib: Lower edge point of the lowest rib at the bottom of the rib cage.

Midspine Tenth Rib: Lower edge point of the lowest rib at the bottom of the rib cage at Midspine.

Lateral Waist: Waist is at the level of the greatest indentation in the torso, or half the distance between 10th rib and Iliocristale if no single indentation is clear. The lateral waist is the lateral point at the level of waist.

Anterior Waist: The anterior waist is the anterior point at the level of waist.

Posterior Waist: The posterior waist is the posterior point at the level of waist.

Projection of Nipple on Waist Line

Lateral Waist Omphalion: Level of the side point of the navel.

Anterior Waist Omphalion: Level of the center point of the navel.

Posterior Waist Omphalion: Level of the back point of the navel.

2.1.4 Body Landmarks in the Hip

Iliocristale: Highest palpable point of the iliac crest of the pelvis, one-half of the distance between the anterior and posterior superior iliac spine.

Anterior Superior Iliac Spine: The front of the ridge hip.

Anterior High Hip

Posterior High Hip

Lateral High Hip

Buttock Protrusion (=Hip): Point of maximum protrusion of the buttock of a standing subject.

Crouch: Body area adjunct to the highest point (vertex) of the included angle between the legs.

Anterior Hip: The anterior point at the hip level.

Posterior Hip: The posterior point at the hip level.

Lateral Hip: The lateral point at the hip level.

Crouch: The middle of the vagina and anus.

Gluteal Fold: The lowest point of the lowest furrow or crease at the juncture of the right buttock and the thigh.

Abdominal Protrusion, Sitting: The most protruding point of the relaxed abdomen of a seated subject.

2.1.5 Body Landmarks in the Legs

Tibiale: Point at the upper inside (medial) edge on the proximal end of the tibial bone of the lower leg.

Superior Patella (=Suprapatella): Upper borders of the kneecap (patella) located by palpitation.

Midpatella (=Kneecap=Patella): The anterior point halfway between the top and bottom of the right patella.

Inferior Patella (=Infrapatella): The lower borders of the kneecap (patella) located by palpitation.

Midthigh: A vertical line halfway between the front and back of the right inner thigh, and extending downward from the level of the gluteal furrow.

Posteior Juncture of Calf and Thigh: The juncture between the right calf and thigh behind the knee.

Calf Protrusion: A point on the side of the calf at the level of the maximum circumference of the right calf.

Inferior Leg

Medial Malleolus: The medial point of the right medial malleolus.

Lateral Malleolus: The lateral point of the right lateral malleolus.

Anterior Knee, Sitting: The most protruding point of the right kneecap of a seated subject.

Posteior Juncture of Calf and Thigh, Sitting: The juncture between the right calf and thigh behind the knee of a subject sitting with the knee flexed 90 degrees.

Metatarsophalangeal I (=Phalangeal Metatarsal I): The medial protrusion of the right foot in the region of the first metatarsophalangreal joint.

Metatarsophalangeal V (=Phalangeal Metatarsal V): The lateral protrusion of the right foot in the region of the fifth metatarsophalangeal joint.

Acropodion: The tip of the first or secind toe of the right foot, whichever is longer.

Ptenrnio (=Posterior Calcaneous): The posterior point of the right heel.

2.1.6 Body Landmarks in the Arms

Deltoid Point: The lateral point of the right deltoid muscle, and the margin of the left deltoid muscle at the level of the right deltoid point.

Bicepts (=Bicep): The highest point of the right flexed biceps as viewed from the subject's right side.

Point Radiale: The highest point of the outer edge Radiale.

Center Olecranon: A point in the center of the curvature of the right olecranon process with the elbow flexed about 115 degrees.

Rear Olecranon: The rearmost points of the right elbow with the elbow flexed 90 degrees.

Bottom Olecranon: The lowest points of the right elbow with the elbow flexed 90 degrees.

Lateral Humeral Epicondyle

Radial Styloid: The lowest point of the bottom of the right radius.

Ulnar Styloid: The lowest point of the bottom of the right ulna.

Metacarpale V: The medial point of the right metacarpophalangeal joint V.

Metacarpale II: The medial point of the right metacarpophalangeal joint II.

Dactylion III: The tip of the middle finger.

2.1.7 Working on BLs with DC-SUITE

When DC-SUITE reads in a body, the body already equips with a set of BLs. DC-SUITE provides the following operations for the manipulation of the body landmarks:

Edit BLs Visibility Table: There is so-called the BLs visibility table, which summarizes the visibility of all the BLs. By this operation, the user can mark or unmark the visibility of each BL.

Turn BLs Visualization On: This operation turns the BLs visualization on, thus the BLs which are marked as visible are displayed.

Turn BLs Visualization Off: This operation turns off the visualization of BLs.

Edit BL allows the user to make modifications to a selected BL. DC-SUITE provides a user interface so that the user can change the name and/or location of the BL.

Create BL allows the user to create a new BL. DC-SUITE provides a user interface so that the user can set the name of the newly created BL, and place the BL at a desired location. Since a DC-SUITE human body already contains a comprehensive set of BLs, this operation will be rarely used.

Delete BL allows the user to delete an existing BL. DC-SUITE provides a user interface so that the user can delete a selected BL. This operation will be very rarely used, since an obsolete BL can be retained without any particular overhead.

2.2 Landmark Lines

Landmark lines (LLs) are (imaginary) lines which can be considered on or around the surface of the body. LLs are defined in terms of the BLs; if the user makes modifications to some BLs, then the LLs dependent on those BLs are redefined accordingly.

2.3 Body Measurements

Waist girth, arm length, etc. Taking measurements of the body are essential for making the constructed garment fit to the body. Body measurements can be classified into two categories: lengths and girths. Lengths are measured between two BLs. Girths are the circumferential lengths.

Each body measurement (BM) is defined in terms of the BLs and Lis in one of the following ways: (1) a BM is the distance between two BLs, (2) a BM is the length of a girth, (3) a BM is the world-aligned distance between two LLs or body extremities, (4) a BM is the length of an LL, or (5) a BM is the summation of several other BMs. Some measurements do not belong to any of the above categories. Since the differences are subtle, by limiting the measurements to the above categories, we can expect some standardization in body measurements.

Classification of Atomic Length Measurements (Length measurements can be classified into the following):

Body-aligned lengths
World-aligned lengths
Hull lengths
Surface lengths

The length measurements can be classified into atomic or non-atomic measurements. Measurement of the (body-aligned, hull, or surface) length between two BLs which belong to the same body segment is called an atomic length measurement. Non-atomic measurements (e.g., total length, arm length) are obtained by summing several atomic measurements. For example, the arm length, which measures the surface length over two segments, is not an atomic measurement.

Classification of Girth Measurements (Girth measurements can be classified into the following):

Body-aligned hull girths
World-aligned hull girths
Body-aligned surface girths
World-aligned surface girths 2.3.1 Primary Body Measurements The set of BMs and their names haven't been standardized yet. But this disclosure attempts a moderate version of standardization: we allow only BMs which is an atomic length measurement, a girth measurement, or a non-atomic measurement. Then, from a given comprehensive set of BLs, any BMs can be defined according to the five conventions introduced above.

Although any combination of the BLs or any circumference can be defined as a BM, typically used BM are the ones listed below. In this disclosure, we will call them as the primary body measurements. The readers are expected to be able to identify the definition of each primary BM.

Stature
Total Length
Waist Back Length
Waist Front Length
Outside Leg Length
Waist to Hip Length
Body Rise
Crotch Height
Crotch Length
Arm Length
Upperarm Length
Elbow-Wrist Length
Neck Point to Breast Point
Neck Point to Breast Point to Waistline
Posterior Leg Length
Lowerarm Length
Outside Hip Height
Breast Point to Waistline
Shoulder Length
Bishoulder Length
Biacromion Length
Front Interscye Length
Back Interscye Length
Bust Point to Bust Point
Head Girth
Neck Girth
Neck Base Girth
Bust Girth
Chest Girth
Underbust Girth
Waist Girth
Hip Girth
Armscye Girth
Upperarm Girth
Elbow Girth
Wrist Girth
Midthigh Girth
Knee Girth
Minimum Leg Girth
Ankle Girth 2.3.1 Taking Body Measurements with DC-SUITE DC-SUITE provides the following operations for body measurements:

Query BL-Passing Girth: draws a circumference passing through the current BL and reports the girth. The display of the circumference lasts until the user types the enter key.

Query Arbitrary Girth: interactively draws a circumference passing through the current mouse point and reports the girth. As the user moves the mouse point, the circumference moves accordingly. The display of the circumference lasts until the user types the enter key.

Query BL-BL Length: draws a line between two BLs and reports its length. When this operation starts, it asks the user to select two BLs and asks the options x/y/z/b/n-aligned and h/s/n-length. The display of the BL-to-BL line lasts until the user types the enter key. DC Suite memorizes the options x/y/z/b/n-aligned and h/s/n-length taken for this length measurement. When the user performs this operation second time with the same BLs (the order of the two BLs may have been switched), the program prompts with the previously used options for x/y/z/b/n-aligned and h/s/n-length. To provide this feature, DC suite maintains so-called the BL-BL length definition table and stores it in a *.BL-BL-LENDEF file. The file resides at a pre-determined folder which was created when the program is installed. When the program starts, it automatically reads (for example) James.BL-BL-LENDEF to get the default length measurement options from the table. As the user redefines the length definitions, the program automatically modifies the table accordingly, and saves the content of the table just prior to the program termination.

Edit BM Definition Table: This operation allows the user to add, delete, or change BM definitions. This operation starts by showing the BM definition table, which lists all the BM definitions, then allows the user to add/delete an entry or modify the content of an existing entry. DC-SUITE provides an initial BM definition table.

Show BM Table: shows the BM table which summarizes the current values of all the BMs.

Turn BM Visualization On: starts displaying the (line(s) representing the) BMs which are marked as visible.

Turn BM Visualization Off: stops displaying the BMs.

Select BM: This operation lets the user select a BM from the BM list (in a text table). The selected BM is then highlighted on the body. Until a new BM is selected, the above BM is regarded as the current BM.

Dump BM Info: prints information on the current BM. The information includes the name, synonyms, and definition of the BM, along with its current value.

2.4 Creation of the Body

Human body can be viewed as an articulated collection of body segments. In this context, a body can be defined in terms of the skeletal part and the geometrical part. Skeletal part defines the lengths of the body segments. Geometrical part defines the shapes of the body segments. Professional modeling of a 3D human body involves a large amount of handwork. Since body modeling itself should not be a primary time/effort taking part of digital clothing, DC-SUITE provides an easy-to-use interface for the creation of the body.

2.4.1 Creating a Body with DC-SUITE

DC-SUITE provides the following operations for creating bodies:

Open Body reads in a *.BODY file. The body includes the face, shoes, accessory, pose/walk, as well as the gross body itself.

Save Body saves the current body along with all the associated components into a *.BODY file.

Set Body Visualization Mode sets the body visualization mode to (1) wireframe, (2) surface, or (3) no-visualization.

Edit Body-Outlining Parameters: modifies the values of the body-outlining parameters. DC Suite currently uses 11 body-outlining parameters: stature, crotch height, head length, arm length, bust girth, waist girth, head girth, upper arm girth, lower arm girth, knee girth, and lower leg girth. In the future, the body-outlining parameters will be augmented with the following additional parameters: shoulder length, neck girth, hip girth, upper leg girth. The user can slide the bars or can provide the numbers to set the parameter values.

Create Body: creates a gross body based on the current values of the body-outlining parameters. The resulting body has the triangular surface mesh, equipped with all the major BLs as well as the skeleton and rigging. Select Walk should be performed anew after this operation. When this operation is performed while a (full) body is already present on the 3D window, then the new gross body replaces the old gross body, keeping the other associated components (e.g., face, hair, etc.) the same. When this operation is performed while no (full) body is present on the 3D window, then a full body is created with the default associated components.

Select Pose lets the user select a pose and then makes the body go into that pose. This operation puts the body into the pose-mode until Select Walk is performed. When the body is saved in the pose-mode, the pose is saved but the walk is not, and vice versa.

Select Walk lets the user select a walk and shows the preview of the walk the current body takes. This operation retargets the prototype walk for the current body. This operation puts the body into the walking-mode until Select Pose is performed.

2.5 Modeling Other Components

Although auxiliary components such as face, hair, shoes, and accessories are not directly related to the construction of clothes, their presence in suitable forms is important in assessing aesthetic impression of the clothing design. DC-SUITE provides various means to model those components.

2.5.1 Face Modeling

The face of the current gross body can be replaced from the selections provided by DC-SUITE. DC-SUITE internally makes necessary modifications to the base of the face so that it seamlessly attaches to the neck of the gross body. DC-SUITE does not allow the users to modify the details such as the face geometry. Currently face modeling in DC-SUITE is done by the following single operation.

Select Face lets the user select a face from the face browser to replace the old face. A face comes with its default hairstyle. The user can replace the default hairstyle with one of the DC-SUITE hairstyle selections or can perform interactive operations to make desired modifications to the hairstyle.

2.5.2 Hairstyle Modeling

Human hair is not a part of clothing construction itself. Nevertheless, an aesthetic judgment of an outfit in association with a particular person can be made properly unless we can see the hairstyle of the person. The hairstyle modeling of DC-SUITE is a self-contained, state-of-the-art technology which is developed for the fashion experts. DC-SUITE provides the following three levels of hairstyling so that people can work on simple models when less visual details need to be worked on the hair, and can move on to more sophisticated models when more detailed/realistic hair is needed.

Static Mesh Representation: This representation models a hairstyle as a static, textured polygonal mesh. A number of static mesh hairstyles are provided by DC-SUITE so, that the user can make interactive selections. In a university class, this representation can be the most popular choice, since it is easiest to use, letting the students focus on clothing design itself.

Static Strands Representation: This representation models a hairstyle with strands which remains static during the character motion. In this hair representation, the user needs to do some amount of interaction if he/she wants to obtain a desired novel hairstyle.

Dynamic Strands Representation: This representation models a hairstyle with strands which make dynamic movements during the character motion. In this hair representation, the user needs to do a large amount of work to obtain a desired hairstyle and its animation.

The hairstyle of the current face can be switched to one among the selections provided by DC-SUITE. The user can apply interactive operations to the selected hairstyle to create a novel hairstyle. DC-SUITE provides the following operations for hairstyling:

Select Hairstyle: The hairstyle browser is provided to allow the selection of the hairstyles. This operation works when a face is present on the window.

Edit Hairstyle Parameters: The property panel is provided for editing hairstyle parameters. Currently the control parameters are the thickness of the strands, length, length-noise, curliness, curliness-noise, and displacement.

Set Hair Shading Options: An interface is provided for setting the hairstyle shading options. Currently the options include the hair color, light color, and shadow maps.

2.5.3 Shoes Modeling

DC-SUITE provides a collection of shoes. There are two types of shoes: high heel shoes and low heel shoes. For simplicity, DC-SUITE assumes the shoes have the following fixed dimensions: for the high heel, the toe height is 0.7 cm, the heel height is 8 cm, the foot length is 24 cm, and for the low heel, the toe height is 1 cm, the heel height is 3 cm, and the foot length is 24 cm for women, 28 cm for men, 20 cm for boys, and 18 cm for girls. For woman, DC-SUITE provides two sets of walking motions: one set for high heels and another set for low heels.

DC-SUITE provides the following operations for shoes modeling:

Select Shoes lets the user select a pair of shoes to replace the current shoes. As high-heel or low-heel shoes are selected, an appropriate version of walking motion needs to be selected. Therefore this operation should be performed before Select Walk. The shoes browser is provided to aid the selection of the shoes. This operation automatically positions the selected pair of shoes to the appropriate location around the feet.

2.5.4 Adding Accessories

DC-SUITE provides a collection of accessories. Available accessories are categorized into earrings, bracelets, broaches, rings, hairpins, and handbags. DC-SUITE provides the following operations for attaching accessories:

Put On Accessory4 lets the user select an accessory and interactively place it at the desired location. When the user hits the enter key, its relative position to the body is finalized.

Edit Accessory Position: lets the user edit the position of the selected accessory relative to the body.

Remove Accessory: removes the selected accessory from the body.

3. Line Drawing

Clothes are constructed by sewing panels together. For the preparation of panels, drawing straight or curve lines is probably the most fundamental operation. In this disclosure, the term 'line' is used to refer a straight or curved line. A panel can be created by selecting a set of lines. As in the conventional clothing production, therefore, the capability to draw lines of various shapes needs to be mastered thoroughly in the study of digital clothing. Line drawing and panel creation are collectively called as the pattern-making stage. This chapter presents the line drawing part, and the next chapter will present the panel creation part.

3.1 Working on Points with DC-SUITE

Points are zero-dimensional entities. Nevertheless, when lines (one-dimensional entities) need to be drawn, points play an important role. For example, a straight line can be defined by giving the two end points, and a curved line can be defined by giving the control points along the curve. DC-SUITE provides the following operations for the manipulation of points:

Create Point creates new points. The points can be created by clicking mouse or by giving the x and y coordinates.

Delete Point deletes a selected point.

Move Point moves the point to a new location.

Create Offset Point creates a new point displaced from an existing point. User selects an existing point (x,y) and gives the displacements (dx,dy). Then this operation creates the point (x+dx,y+dy).

Create Average Point creates a new point in the middle of two selected points.

Merge Points merges a selected group of points into a single point. The points are merged into the firstly selected point. In the process of pattern-making, a number of points may exist at almost the same location. This operation can be used when it is more manageable/desirable to merge those points into a single one. This operation works whether (1) the points are isolated points or (2) they are currently being used for defining a line.

Align Points aligns selected points by applying appropriate translations. Alignment can be done vertically or horizontally.

3.2 Point-Line Relationship

Suppose that a point is lying on a line. What would be the possible relationship between the point and the line? There are three possibilities:

Unbound: The point is not bound to the line. The point just happens to lie on the line.

Dividing: The point divides the line into two connected lines. Note that we don't call the resulting two pieces line segments but we call them lines. Moving the point transforms it into a bent configuration.

Cutting: The point cuts the line into two separate lines. The resulting two lines can be moved or stretched independently afterwards.

We emphasize the difference between dividing and cutting. We say a point divides a line when the two resulting pieces meet at a point and continue to be connected at that point. On the other hand, we say a point cuts a line when the points cuts the original line into two separate independent lines.

3.3 Operations for Two Crossing Lines

Two different operations can be defined in the context of two mutually crossing lines:

Line-Line Dividing: This operation causes dividing to be done at the intersection. This operation can be performed in two variations: In One-way Line-Line Dividing, one divides the other line into two lines, with the former remaining intact. In Mutual Line-Line Dividing, the two lines divide each other.

Line-Line Clipping: This operation causes cutting to be done at the intersection and obsolete segment(s) is (are) removed. This operation can be performed in two variations: In One-way Line-Line Clipping, one clips the other line, with the former remaining intact. In Mutual Line-Line Clipping, the lines clip each other.

3.4 Working on Lines with DC-SUITE \label{SEC:LineOPs

DC-SUITE provides the following operations for the manipulation of lines:

Create Straight Line creates a straight line.

Create Offset Line creates a line which is of the same length but displaced from the selected line along the perpendicular direction.

Create Parallel Line creates a line which is parallel to the selected line. Differently from Create Offset Line, the new line can start at an arbitrary position and can extend to an arbitrary length.

Create Perpendicular Line creates a line which is perpendicular to the selected line.

Create Straight Lines creates a sequence of connected straight lines.

Create Curved Line creates a curved line that passes through the user-specified control points.

Add Control Points adds new control points on the selected curve.

Extend Line extends the selected line.

Mirror Line creates a symmetric line. User selects two lines: Line A and Line B. Line B is the axis of the symmetry. It creates Line C which is symmetric to Line A with respect to Line B.

Merge Lines merges selected two adjacent lines into a single line.

n-Divide Line divides the selected line into n lines of equal length.

x-Divide Line divides the selected line into two lines of a desired ratio.

n-Cut Line cuts the selected line into n lines of equal length.

x-Cut Line cuts the selected line into two lines of a desired ratio.

One-Way Line-Line Divide divides a line w.r.t. another crossing line.

Mutual Line-Line Divide divides a line w.r.t. another crossing line, and vice versa.

One-Way Line-Line Clip clips a line w.r.t. another crossing line.

Mutual Line-Line Clip clips a line w.r.t. another crossing line, and vice versa.

Create Notch creates a notch on the selected line. (This operation creates an unpaired notch. Paired notches can be created in the garment construction stage.)

Edit Notch edits the position of a selected notch.

Delete Notch deletes a selected notch.

Align Lines Aligns selected lines with various options.

Create Rectangle creates a rectangle consisting of four closed straight lines.

Create Circle creates a circle.

The results of the above operations can be saved into a pattern-making file (.pmf), which is the groundwork for creating panels.

4. Panel Creation

In order to construct a garment on the computer, the first thing you should do is to prepare the cloth panels. This chapter is about creating panels. If you have prior experience on conventional clothing production, the basic mechanism of digital panel-creation should be intuitively understandable.

We use the term cloth panel or simply panel to refer to a piece of cloth (which is cut according to the shape of the pattern. In the conventional clothing, a pattern is a prototype made of paper used to prepare a panel. In digital clothing, however, as soon as a set of lines are selected, the result is regarded as a panel. Therefore patterns (in the conventional meaning) are never made. For this reason the term "pattern" alone is rarely used in digital clothing. But in this disclosure we will still use the compound term "pattern-making" to refer drawing of points and lines in the process of creating panels.).

Panel contour refers to the boundary line(s) which define a panel. Seams are usually made along the panel contour. A panel is cut with some margin for seams, which is called the seam allowance. In this disclosure, we will refer the panel without the seam allowance as the panel, and the panel with the seam allowance as the master panel.

4.1 The Textile Coordinate System

The selvage (or selvedge, self-edge, list, listing) refers to the edge of a textile role. Weft is the fiber which runs across the width of the textile, while warp (or filling, pick, woof) is the fiber which runs in parallel with the selvage. The grain collectively refers to the warp and weft.

For creating a panel, its geometrical shape is not the only thing that needs to be specified; its orientation with respect to the grain also has to be specified. When drawing panels on the screen, therefore, we need to have some sort of coordinate system. This disclosure will use the following convention. Unless otherwise told, we will assume that x-axis (horizontal rightward direction) of the pattern-making window is along the warp direction, and y-axis (vertical up direction) is along the weft direction. The right side of the textile is facing toward us from the screen. When textiles are manufactured, one side is supposed to be outside and the other side is supposed be inside, which are referred in this disclosure as the right side and the wrong side, respectively. This convention will be used throughout this disclosure.

4.2 Pattern-Making vs. Panel-Creation

A pattern-making file (.pmf) stores a collection of points and lines, along with the panels which are currently under construction. Those points and lines, which are called the pattern-making points/lines, are just geometrical entities, and do not define a cloth piece yet. A pattern-making file stores a number of pattern-making layers each of which contains its own collection of points and lines. The layers are visualized on the pattern-making window. Each pattern-making layer can be translated, rotated, scaled. Display of each pattern-making layer can be controlled. For example, display of a pattern-making layer can be turned on/off, dimmed, darkened, etc.

A panel is a cloth piece which is the building block to form a garment. Points and lines comprising a panel are referred as the panel points/lines. Each panel in the pattern-making window can be saved into or read from a panel file (.pnl). A .pmf file is contrasted from a .pnl file: a .pmf file stores the whole workspace of points, lines, and panels, which can be in incomplete/intermediate states, on the other hand, a .pnl file stores only a complete panel.

A new pattern-making file can be read or imported while working with a pattern-making file. When a pattern-making file is read, the old panels and pattern-making layers are all removed and the new panels and pattern-making layers are read into the pattern-making window. When a pattern-making file is imported, instead of removing the old content, the pattern-making window is augmented with the new set of layers (and panels if the user specifies so). The user can save the current content (it does not need to be complete content but can be on-going intermediate content) of the pattern-making window into a pattern-making file, in which case all the pattern-making layers and panels in the window are saved.

4.3 Pattern-Making Window

Visualization of both pattern-making points/lines and panels is done on the same window, i.e., the pattern-making window. It can be viewed as that the panels are drawn on top of the pattern-making layers. When a panel is deleted or its display is turned off, the pattern-making points/lines beneath the panel are exposed. When a panel line is elongated, the pattern-making line underneath it remains intact. Display of panels can be contrasted from the display of pattern-making points/lines by controlling the darkness, line width, line type, etc.

4.4 Creating Panels with DC-SUITE

DC-SUITE provides the following operations for the creation of panels:

Create Panel creates a panel from a set of (pattern-making) lines. The lines, which must be closed, define the contour of the panel. Since panels are often created in pairs (left and right), program asks the user if a mirror-version of the panel should also be created. Therefore, this operation creates one or two panels.

Create Symmetrical Panel creates a symmetrical panel. From a chain of lines and a symmetry axis line, it forms a panel of a symmetrical shape. The chain of lines and the symmetry axis must form a closed region. This operation creates a single panel.

Delete Panel deletes the selected panel. After this operation, the original pattern-making points/lines, if they exist, are retained.

Open Panel reads in a panel to the pattern-making window.

Save Panel saves a panel into a .pnl file.

Save Pattern-Making File saves the current content of the pattern-making window into a .pmf file.

Open Pattern-Making File reads in a .pmf file into the pattern-making window. This operation removes the previous content (if there was any).

Import Pattern-Making File imports a .pmf file into the pattern-making window. This operation keeps the previous content and adds the new content on top of it.

Align Panels aligns panels.

4.5 Editing in the Pattern-Making Window

In the pattern-making window, (1) additional points and lines can be created on a new pattern-making layer or on an (user-specified) existing pattern-making layer, (2) a new panel can be created, and (3) a panel can be edited by applying various operations to the panel points/lines, the pattern-making points/lines, or the mixture of those two (e.g., cutting out a portion of the panel with a pattern-making line, or replacing some portion of the contour with a new line).

The system records the time when the last modification is made to the panels. When a subsequent stage (i.e., the garment/attire/simulation/rendering stages) is performed, if the recorded time is more recent, then the program may automatically perform some necessary steps.

4.6 Editing Panels

A panel can be modified by moving its points, stretching or dividing its lines. Operations for editing panels are borrowed from the pattern-making operations (i.e., the operations defined for drawing/editing points/lines.) For editing panels, we take only the pattern-making operations which leave panels in valid states. A panel is said to be in a valid state if the contour is simple and closed. For example, a Cut Line or Clip operation can cause the panel to go into an invalid state. Three additional operations are defined to allow for more dramatic editing of panels. Replace Contour replaces a portion of the contour with a new sequence of lines. Cut Panel cuts a panel with a given line and creates two new panels. Merge Panels is the inverse of Cut Panel operation.

4.7 Editing Panels with DC-SUITE

DC-SUITE provides the following operations for editing panels:

Move Point moves the selected point to a new location.

Add Control Points adds new control points on the selected curve.

Extend Line extends the selected line.

Merge Lines merges selected two lines into a single line. This operation does not work unless the two lines are already adjacent and collinear. This operation does not work if the dividing point is currently the start or end of a seam line. If the merge has to be done, in this case, the seam line must be deleted first, then perform the merge, and then the seam line needs to be created appropriately.

n-Divide Line creates points on the selected panel line so that the points divide the line into n lines of equal length.

x-Divide Line creates a point on the selected panel line so that the point divides the line into two lines of desired ratio.

One-Way Line-Line Divide divides the selected panel line w.r.t. a crossing pattern-making line.

Mutual Line-Line Divide divides the selected panel line w.r.t. a crossing pattern-making line, and vice versa.

Create Notch creates a notch on the selected line.

Edit Notch edits the position of a selected notch.

Delete Notch deletes a selected notch.

Replace Contour: The user specifies a connected sequence A of the panel lines that need to be deleted, and another connected sequence B of pattern-making lines which will replace the deleted part. The start and end points of A and B must coincide. This operation can achieve panel clipping, expansion, or a mixture of those two. This operation is usually done in combination with Mutual Line-Line Divide. If seams had been defined for the panel, both seam line definition and seam definition need to be explicitly revised after this operation.

Cut Panel: With a given pattern line, it cuts the selected panel into two separate panels. After this operation, the two new panels exist in the grouped-state. If the user wants to position the panels separately, she/he should ungroup them. If seams had been defined for the panel, both seam line definition and seam definition need to be explicitly revised after this operation.

Merge Panels: This is the inverse of Cut Panel operation. It merges two adjacent panels into one. Unless the two panels fit at the boundary, the operation does not do anything. If seams had been defined for the panel, both seam line definition and seam definition need to be explicitly revised after this operation.

4.8 DC-SUITE's Other Operations on Panels

There are several additional operations in DC-SUITE which can apply to already existing panels:

Create/Edit/Delete Internal Cut: makes a cut to the panel along a selected pattern line. When a panel needs to be cut into two separate pieces, Cut Panel operation must be used. This operation is intended for a cut made interior of the panel Create/Edit/Delete Internal Seam: makes a seam along a selected pattern line. The seam generated with this operation is different from the usual seams defined along the contour of the panel. The seam generated by this operation comes interior of the panel. A typical use of this operation is for attaching a pocket.

Create/Edit/Delete Decorative Stitch: makes a decorative stitch along a selected pattern line. This operation is different from the usual seam in that it is not used for attaching panels. A typical use of this operation is the decorative stitch line on jeans.

Create/Edit/Delete Hollow: defines a closed region within the panel by selecting a set of pattern lines, and cuts out the enclosed region.

Create/Edit/Delete Text Label: creates a text box label interior of the panel.

Create/Edit/Delete Figure Label: creates a figure label interior of the panel.

Create/Edit/Delete Button: marks the position for the buttons and creates them. This operation creates new (multiple) buttons in addition to the previously existing ones. The buttons will be visualized in different levels of details automatically according to the current visualization context. These two conventions apply also to the button hole, hook, zipper, and belt holder.

Set Button Type: After the user selects a button type with this operation, Create Button will create buttons of this type until the button type is selected anew.

Create/Edit/Delete Buttonhole: marks the position for the buttonholes and creates them.

Set Buttonhole Type: After the user sets the buttonhole type with this operation, Create Button Hole will create a buttonhole of this type until the buttonhole type is set anew.

Create/Edit/Delete Hook: marks the position for the hooks and creates them.

Set Hook Type: After the user selects a hook-pair with this operation, Create Hook will create hook-pairs of this type until the hook-pair is selected anew.

Create/Edit/Delete Zipper: draws a line and puts a zipper along this line.

Set Zipper Type: After the user selects a zipper with this operation, Create Zipper will create zippers of this type until the zipper type is set anew.

Create/Edit/Delete Belt Holder creates loops to hold a belt.

Set Belt Holder Type: After the user sets the belt holder type with this operation, Create Belt Holder will create belt holders of this type until the type is set anew.

4.9 Panel Positioning

In order to create a garment out of panels, the panels need to be positioned at proper places. It is so obvious in the conventional clothing that it may sound even odd to mention it. In the conventional clothing, people position panels almost subconsciously. In digital clothing, however, panel positioning is an important component which the user needs to pay a great deal of explicit attention. Adjacent panels need to be positioned at neighboring locations for the creation of seams, which is same as in the conventional clothing. But panels also need to be positioned properly in 3D with respect to the body in digital clothing. This new requirement may not look intuitive. But proper body-relative panel positioning is a very important requisite if the previewing of the clothes needs to be done.

DC-SUITE provides an interface to aid the user to arrange the panels into desired locations. The result of user's positioning effort can be stored so that the panels can be positioned at proper places without any further user intervention.

4.9.1 Grain Lines and Panel Positioning Frame

The lines representing the warp and weft directions are collectively called the grain lines. In this disclosure the grain lines are visualized as two orthogonal crossing axes, the longer one representing the warp direction. Since the grain lines encode only the directions, the position of the lines does not carry any information. Since the pattern-making window is aligned with the grain lines, visualizing the grain lines do not make much sense in the panel creation stage. But in subsequent stages, the grain lines may need to be displayed. The display of the grain lines can be turned on/off, the default being turning off.

The panel positioning frame is the 3D coordinate system imbedded in the panel to encode the relative position of the panel with respect to the body when constructing the garment. The panel positioning frame is visualized as two orthogonal axes and another axis coming out of the panel which is not shown in the figure. The display of the panel positioning frame can be turned on/off, the default being turning off.

The local frame is created/used implicitly; the user does not need to know whether a frame exists or when such a frame is being used. But the concept of local frame can facilitate technical discussion on panel positioning with respect to the body in the garment creation stage.

4.9.2 Panel Positioning with Offset Planes

There are five offset planes: the front, back, left, right, and top offset planes. The amount of offset from the body can be modified. In the garment construction stage, when a panel is double-clicked with the front [back, left, right, top] view, the panel is placed on the front [back, left, right, top] offset plane. The user may need to further translate/rotate the panel to a proper location. The required accuracy of the positioning depends on whether it is in the garment creation stage or attire setup stage.

4.9.3 Creating the Panel Positioning Tips

The body-relative position of a panel (i.e., the position of the panel around the body when the garment is put on the body) is encoded by the discrete body coordinates and the panel landmark lines. These two kinds of information is collectively called the panel positioning tips. The panel positioning tips are stored in the panel data, so that the information can be accessed in the subsequent garment/attire creation and try-on stages. The tips are initialized when a panel is created, and can be modified as needed subsequently.

The discrete body coordinates of a panel is a 3-tuple (A,B, C), where A, B, and C are taken from the body parts, longitudes, and latitudes, respectively. The choices for the body parts are Head, Left-Head, Right-Head, Neck, Left-Neck, Right-Neck, Torso, Left-Torso, Right-Torso, Left-Arm, Right-Arm, Legs, Left-Leg, Right-Leg, Left-Foot, and Right-Foot. The left/right is taken in terms of the body, not in terms of the viewers. Bold-faced ones are the most frequently used ones. Left/Right-Torsos [Left/Right-Heads, Left/Right-Necks] are used rather than Torso [Head, Neck]when such use is more convenient. For example, when a non-separate panel covers both left and right torso, people may find using Torso more convenient. However, when panels are created separately for the left and right torso, people may find using Left/Right-Torsos more convenient. The choices for the longitudes are Front, Back, Left, and Right. For Left/Right-Head/Neck/Torso, the longitude Right/Left is not used. The choices for the latitudes are Top, Bottom, and Middle.

The landmark lines of a panel consists of y-axis (the vertical up line) and x-axis (horizontal line) which are orthogonal to each other. When the longitude is Front/Back/Left/Right, the landmark lines come on the front/back/left/right plane of the panel positioning box. The origin, x and y axes of the landmark lines are determined as follows: In the panels for Torso and Left/Right-Torso, y axis indicates the projection of the torso center line onto the front plan of the box and x axis indicates the waist line. (The two axes must form a right-handed 2D frame.) For Legs, y and x axes indicate the (projection of) midway line between the two legs and the waist line, respectively. For Left/Right-Leg, y and x axes indicate the (projection of) leg center line and the waist line, respectively. For Left/Right-Arm, the landmark lines indicate the (projection of) arm center line at the Acromion (top of the shoulder) level. For Head and Left/Right-Head, the landmark lines indicate the (projection of) head center line at the Vertex level. For Neck and Left/Right-Neck, the landmark lines indicate the (projection of) vertical center line at the Anterior Neck level. For Left/Right-Foot, the landmark lines indicate the (projection of) lower leg center line at the sole level. At the initial creation, they are drawn (of course, the display can be turned off) at a default location on (sometimes in the outside of) the panel, so that the user can freely translate or rotate to a desired location. In addition to the information encoded in the discrete body coordinates, the landmark lines provide more detailed information about where the panel should be positioned. Landmark positioning needs to be done with some accuracy but does not need to be done with an utmost accuracy. The latitudes are used to determine the default position of the landmark lines. But they become obsolete as soon as the user positions the landmark lines to a proper place.

4.9.4 Grouping Panels

The task of positioning a set of panels can be done more conveniently if the user can treat them as a group. For example, panels created for the left leg can be grouped to position them together. When panels are grouped, the group landmark lines are newly created, so that the user can locate the group into a desired position. The relative position among the panels is kept fixed after they are grouped. If the relative position needs to be changed, the user must un-group the panels, set them into new positions, and then group the panels again. For the panels which form a group, the original individual landmark lines are not editable by the user. They are maintained internally by the system.

4.9.5 Three Stages of Panel Positioning

The user is expected to perform panel positioning in the panel creation stage, garment creation stage, and attire creation stage. The purposes and required accuracies of the positioning in those stages are all different.

Panel Positioning in the Panel Creation Stage: The purpose of the panel positioning in this stage is to label just a rough target place of a newly created panel. At this stage, since the user is working on the panel window in which the body is not visualized, he/she is normally expected to specify only the discrete body coordinates. Although not recommended, the user who is aware of the body-relative positioning and who is willing to the work which is normally expected to be done in the garment creation stage may go ahead and set the position of the landmark lines in the panel creation stage.

Panel Positioning in the Garment Creation Stage: Panel positioning in this stage is to aid the identification of seam line pairs and to aid designation of the seams. At this stage, with the visual cue provided by the garment window, the user is expected to set the position of the landmark lines in such a way to facilitate the garment creation task. But it is recommended that the user put a little more effort at this stage and position the panels in such a way to satisfy the requirements of the attire creation stage as well.

Panel Positioning in the Attire Creation Stage: Panel positioning in this stage is to put panels into a trouble-free configuration in preparation for the static/dynamic simulation. When the panels are in inappropriate positions, static/dynamic simulation can produce an anomalous result. Therefore some level of experience and accuracy is needed for this. Positioning panels in the attire creation stage, in which all the garments are seen, can be overwhelming. It is recommended that major positioning task is done in the garment creation stage so that only some minor adjustment needs to be done in the attire creation stage.

4.9.6 Positioning Panels in DC-SUITE

DC-SUITE provides the following operations for positioning panels:

Edit Grain Lines: sets up the grain lines (the selvage and weft directions) to a new direction.

Edit Panel Positioning Tip: edits the panel positioning tips. This operation can modify the discrete body coordinates and/or the landmark lines.

Group Panels: groups a set of panels into a group so that they can be positioned with their relative position remaining fixed. After this operation is performed, the individual landmark lines are not editable until the panels are ungrouped.

Ungroup Panels: ungroups the group. After this operation, the individual landmark lines reflect the current locations and become editable again.

Edit Group Landmark Lines: edits the group landmark lines.

4.10 Importing Panels

Panels existing in other formats (e.g., DXF, Gerber, Lectra) may need to be imported. Most digital clothing softwares provide format conversion functions to deal with such situations. In some cases, printed or hand-drawn patterns or actual cloth panels may need to be imported. For those cases, scanner or camera based importing is employed. Importing a panel or printed pattern can be done also with a digitizer. However, this kind of importing is becoming obsolete; it is being replaced by scanner/camera-based importing. So this disclosure will not cover digitizer-based importing. This section presents how such imports can be performed. Depending on the design of the course, this section can be postponed to the end of the course.

5. Garment Construction

A garment is a dress piece formed by sewing a set of panels to each other. In the garment construction stage, atomic elements are panels. Garment construction consists of two major parts: panel selection and seam creation; a set of panels must be selected before seams can be defined among them.

Garment construction is done on the garment window. The garment window is different from the pattern-making window. For the garment construction, panels need to be positioned around the body in order to facilitate the matching of corresponding seam lines. Therefore, 3D position of the panels with respect to the body is practically important information in the garment construction stage. Display of the body can be turned on/off, with the default being turning on. The translucency of the body and panel display can be controlled. The current body can be switched to another body at any time of the garment construction stage. In the garment construction stage, the body is visualized just to aid finding the corresponding sides (seam lines) of the seams. But it is recommended that the same body is used throughout the whole digital clothing process including the panel/garment/attire creation and the try-on test.

5.1 Creating a Garment with DC-SUITE

DC-SUITE provides the following operations for creating garments:

Create Garment: creates a garment which initially consists of zero panel. This operation, after taking the name from the user, generates a new icon. Panels can be added to or deleted from the garment afterwards. Seams can be defined only between the panels which belong to the same garment.

Add Panel to Garment: adds a panel to the garment.

Delete Panel from Garment: deletes a panel from the garment. For the panel which still belongs to the garment, the seams/notches are removed automatically after this operation.

Save Garment: saves the garment into a file.

Open Garment: reads in a garment which was stored in a file.

Save Garment Construction File: saves the current content of the garment (construction) window into a .gcf file. It saves all the panels, positions of them, and seams defined between them. The main difference between a .garment file and a .gcf file is that a .gcf file is used to store an on-going (incomplete) result so that the garment construction can be continued afterwards.

Open Garment Construction File: reads in a .gcf file.

5.2 Introduction to the Garment Window

In constructing a garment, identification of corresponding seam line pairs should be done extensively. The garment window is designed to facilitate viewing of the corresponding seam lines. In the garment window, five [six] boxes enclose the torso [left/right torsos], arms, legs, so that the panels are positioned on the faces of the boxes. Those boxes are called the panel positioning boxes. DC-SUITE automatically places the panels according to the panel positioning tips (created in the panel creation stage), but the user can interactively modify the position of the panel within the face if it helps perform the seam line matching task. Translucency of the panels and the body can be controlled as needed.

The garment window shows individual boxes or any combinations of the boxes in the following views:

Parallel or Perspective

Orthogonal, {30°, 45°, 60°}-Oblique, or Arbitrary Viewing Direction

Any subset of Front, Back, Left, Right faces 5.3 Anatomy of Seam

A seam line is a line on a panel along which a seam will be created. A seam can be created by selecting two corresponding seam lines. Those corresponding seam lines are collectively called a seam line pair. The two seam lines of a seam line pair do not need to have the same length, in which case the seam is called an anisometric seam.

The start and the end of a seam line is called the seam start and the seam end, respectively. A panel can have notches which mark the places at which the seam must coincide. Notches are internally represented as dividing points. Therefore, whether panels contain notches or not, we just need to define seams between seam lines, without giving any further consideration on notches.

A seam, when it is anisometric, can be seamed with the following eight options: (1) proportional, (2) easy-start, (3) easy-end, (4) easy-middle, (5) easy-start-easy-end, (6) easy-start-easy-middle, (7) easy-middle-easy-end, and (8) easy-start-easy-middle-easy-end.

When a panel is brought up on the garment window, each panel line automatically becomes a seam line. It is more accurate to say that panel lines and seam lines are identical; we just call the lines on the panel contour as panel lines in the panel creation stage, but we call the same lines as seam lines in the garment creation stage. The same operations defined for editing the panel lines can be used for seam lines.

5.4 Creating Seams

Creation of a seam consists of three parts: (1) preparing seam lines, (2) creating seams, and (3) specifying seam options:

Preparing Seam Lines: This part prepares the seam lines and sets up the notches. (Related operations: Coalesce Seam Lines, Coalesce Seam Lines with Notch, n-Divide Seam Line, x-Divide Seam Line, Notch-Divide Seam Line, Create Notch, Edit Notch, Delete Notch)

Creating Seams: This part specifies which seam lines should be seamed to each other. This part registers a seam so that further options can be selected for it. (Related operations: Create Seam, Delete Seam, Reverse Seam Line, Reverse Seam Line with Twist)

Specifying Seam Options: This part sets up how seaming of each seam interval should be done. It sets the seam type to (1) plain, (2) flat-felled, (3) French, etc., the default being plain. It sets the anisometric seam mode to one of the eight seaming options. Specification of seam options may be omitted. When they are omitted, default options are used. For example, anisometric seam lines are seamed proportionally. (Related Operations: Set Seam Type, Set Anisometric Seam Option)

5.4.1 Creating Seams with DC-SUITE

DC-SUITE provides the following operations for creating seams:

Move Panel: translates or rotates the selected panel within the face of the panel positioning box. It results in the change in the landmark lines. The change can be saved or unsaved according to the user's decision. This operation also allows to change the discrete body coordinates, so that a mistake made in the panel creation stage can be fixed here.

Set Pane/View: sets the active panes and the viewing options for the garment window. It sets which boxes should be shown, which faces should be shown, whether they should be shown in orthogonal/oblique, etc. Most of these are also doable with the keyboard.

Create Notch: It creates a notch on a selected seam line. Note that this operation, which was defined in the pattern-making stage, can be used also in the garment construction stage. When this operation is performed in the garment window, the user can see the two related panels side by side while creating the notch.

Edit Notch: edits (translates along the contour) the selected notch. When this operation is performed in the garment window, the user can see the two related panels side by side while creating the notch.

Delete Notch: deletes the selected notch.

Reverse Seam Line: reverses a seam line, so that the seam start becomes the seam end and vice versa. All the notches and intervals are reordered accordingly. The seam start and end are marked in different colors. So the user can verify whether this operation took effect. This operation reflects the reversal to the seam data structure only. It corresponds to flipping the whole panel upside-down. In order to have the effect of twist in the mesh, Reverse Seam Line with Twist should be used.

Reverse Seam Line with Twist: Reverses a seam line, so that the seam start becomes the seam end and vice versa. The reversal occurs not only to the seam data structure but it entails twist in the mesh.

Create Seam: creates a seam between a pair of seam lines. The two seam lines can be taken from the same panel (e.g. in creating a sleeve). The two seam lines paired by this operation are drawn in an identical color (determined by the computer). Seam lines may contain notches. This operation creates a seam in which the corresponding notches coincide each other from the seam start to seam end. This operation is aborted with a warning if the number of notches is not the same for the seam line pair.

Set Seam Type: sets the seam type to (1) plain, (2) flat-felled, (3) French, etc.

Set Anisometric Seam Option: specifies how an anisometric seam should be made. It sets the current anisometric seam option to (1) proportional, (2) easy-start, (3) easy-end, (4) easy-middle, (5) easy-start-easy-end, (6) easy-start-easy-middle, (7) easy-middle-easy-end, or (8) easy-start-easy-middle-easy-end, with the default being proportional. This option applies to each seam interval when a complete seam is made, and to each actual seam interval when a partial seam is made, until it is switched to another option.

Delete Seam: deletes the selected seam. After performing this operation, the color of the seam lines goes back to black.

Change Seam Color: This operation is used to make an explicit change to the color which was (automatically) assigned to a seam.

Set Seam Color Preference: sets the color preferences for seams.

5.5 Intelligent Accommodation of Minor Edits to Panels

In digital clothing process, the user should be able to edit panels at any stage. For example, the user should be able to edit panels after the garment is defined or after dynamic simulation is performed. When a drastic change is made to a panel, i.e., when the operations Replace Contour, Cut Panel, or Merge Panels are performed, the seam lines need to be revised and the seams needs to be redefined explicitly. However, it would be cumbersome to redo the garment, attire stages every time a minor change is made to the panel. Some rules are set up so that, whenever a panel is edited, the specifications made at the garment/attire stages are automatically revised in a predefined way, without explicit intervention from the user. A rule used in DC-SUITE: it assumes that the dividing points, notches in the range of edited part of the contour is scaled while preserving the arc-length ratio.

5.6 Garment Setup with DC Studio

DC-SUITE provides the following operations for setting up a garment:

Setup Button: With this operation, the user sets how the buttons are matched with the buttonholes, and whether the buttons should be locked.

Setup Zipper: With this operation, the user sets how much fraction of the selected zipper should be closed.

Setup Hook: With this operation, the user sets whether the selected hook-pair should be locked.

Setup Belt: With this operation, the user sets whether the belt should be tightened or loosened. Selection of the belt itself is discussed in the Accessory chapter.

Setup Sleeve: determines the initial setup for the sleeves.

Setup Collar: determines the initial setup for the collar.

Figure 2:
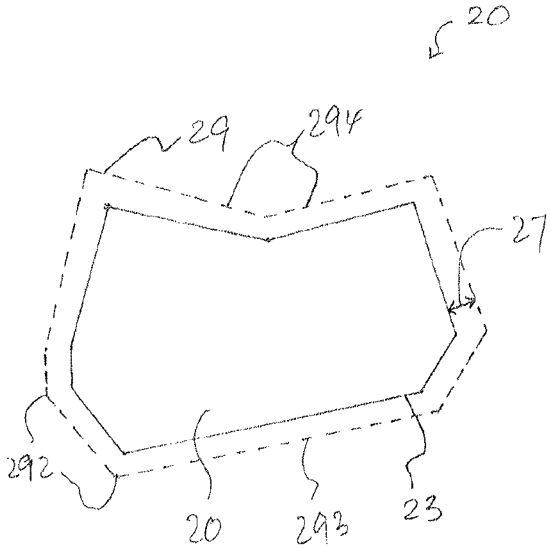
FIG. 2 is a perspective view showing a master panel according to an embodiment of the invention.
Figure 3:
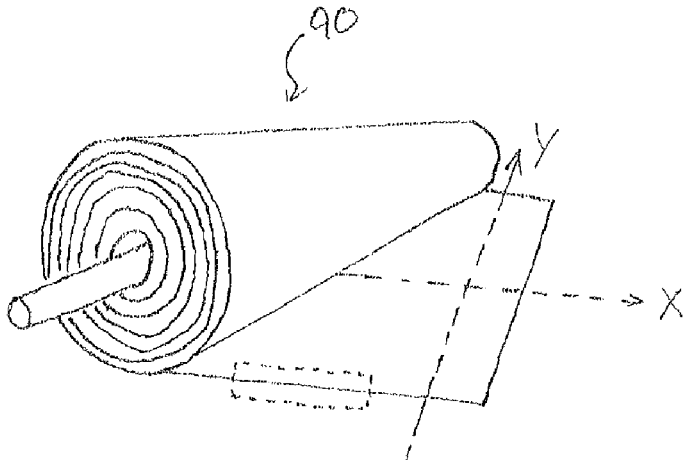
FIG. 3 is a perspective view showing a textile roll.
Figure 4:
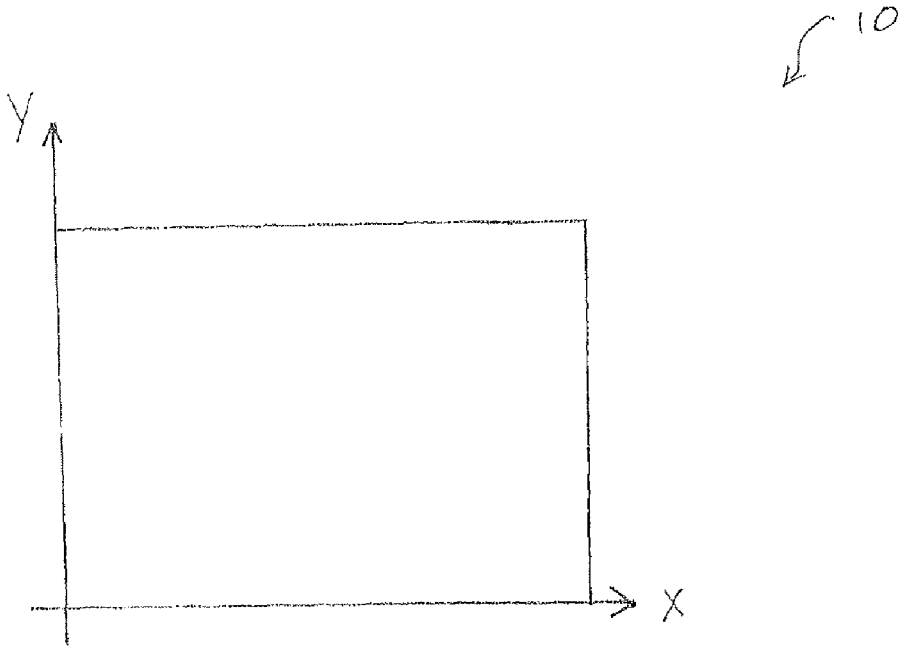
FIG. 4 is a diagram showing a textile coordinate system according to an embodiments of the invention.
Figure 5:
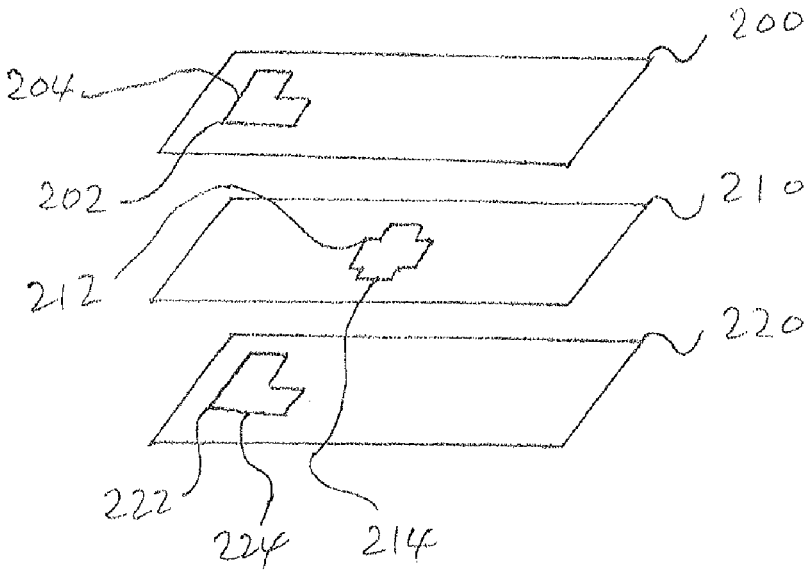
FIG. 5 is a perspective view showing layers for a panel.
Figure 6:
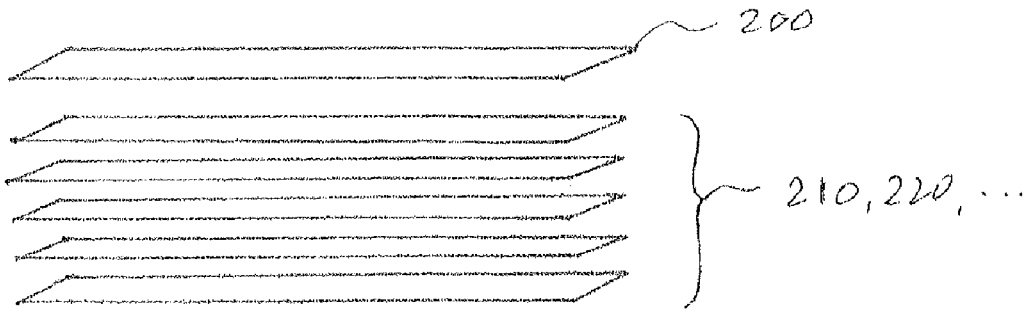
FIG. 6 is another perspective view showing the layers for a panel.
Figure 7:
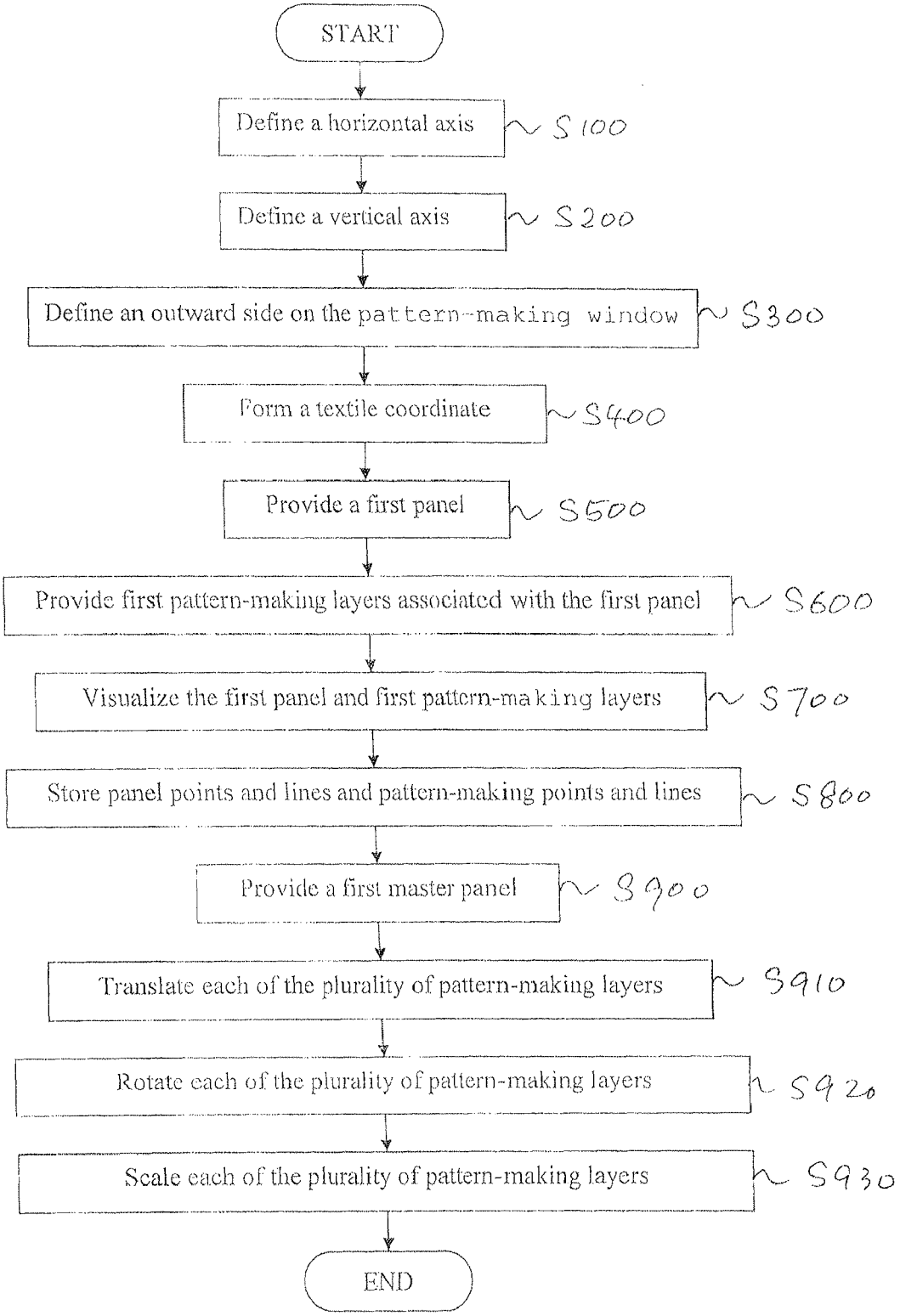
FIG. 7 is a flow chart for illustrating steps for creating panels.

FIGS. 1 and 2 are perspective views showing a panel and a mater panel according to an embodiment of the invention. FIGS. 3 and 4 show a textile roll and a diagram showing a textile coordinate system according to an embodiments of the invention. FIGS. 5 and 6 are perspective views showing layers for a panel. FIG. 7 is a flow chart for illustrating steps for creating panels.

Figure 8:
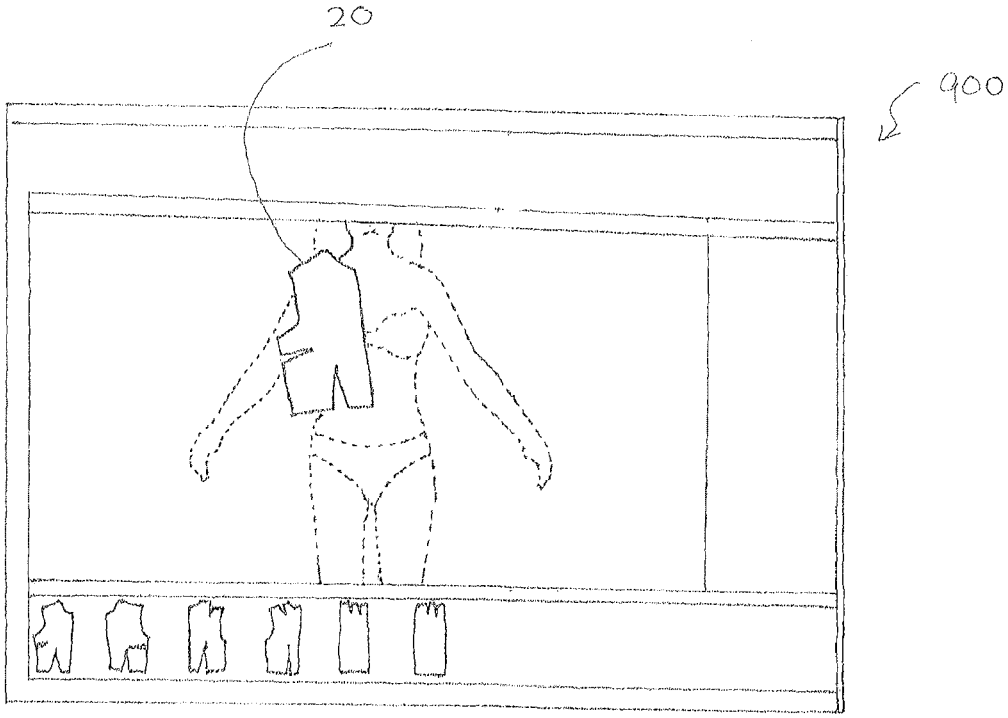
FIGS. 8 and 9 show panel positioning on a computer display.
Figure 9:
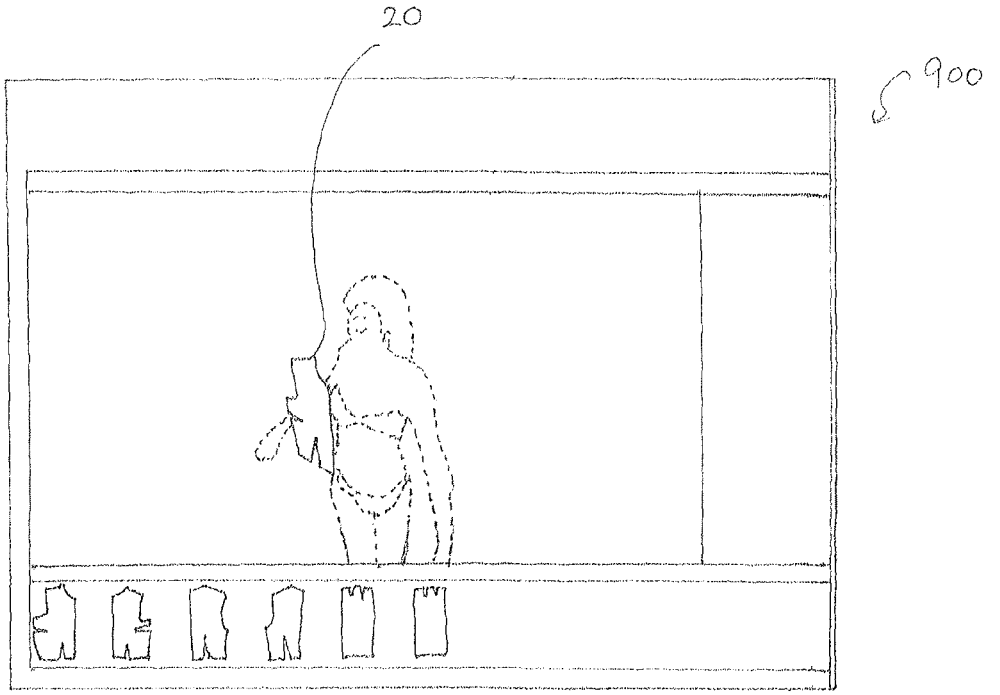

In an embodiment of the invention, a method for creating panels for a garment using a textile coordinate system 10 in a digital clothing comprises steps of:

defining a horizontal axis x on a pattern-making window (not numbered, background of FIGS. 1 and 2), which may be displayed on a computer display 900 as shown in FIGS. 8 and 9 (S100);

defining a vertical axis y on the pattern-making window (S200);

defining an outward side on the pattern-making window toward an observer in front of the pattern-making window (S300);

forming the textile coordinate system defined by the horizontal axis x and the vertical axis y on the outward side of the pattern-making window (S400);

providing a first panel 20 comprising a plurality of panel points 22 and lines 24 defined on the textile coordinate system 10, wherein the plurality of panel points 22 and lines 24 form a closed boundary, that is a panel contour 23 (S500);

providing a plurality of first pattern-making layers 200, 210, 220 associated with the first panel 20, each of which comprising a plurality of pattern-making points 202, 212, 222 and lines 204, 214, 224, wherein the plurality of pattern-making points and lines form a pattern (S600);

visualizing the first panel 20 and at least one of the plurality of first pattern-making layers 200, 210, 220 on the pattern making window (S700); and storing the plurality of panel points and lines and the plurality of pattern-making points and lines in a pattern-making computer file (S800).

The panels in FIGS. 1 and 2 may be shown on the pattern-making window (not shown, or the background of FIGS. 1 and 2).

The horizontal axis x may be along a warp direction of a textile roll 90. The vertical axis y may be along a weft direction of the textile roll 90 as shown in FIGS. 3 and 4.

The method may further comprise a step (S900) of providing a first master panel 29 comprising the first panel 20. The first master panel 29 may further comprise a seam allowance 27 provided around the first panel 20. The first mater panel 29 may further comprise a plurality of master panel points 292 and lines 294 defining a master panel contour 293 as shown in FIG. 2.

The plurality of panel points and lines may form a panel contour 23.

The method may further comprise steps of:

translating each of the plurality of pattern-making layers on the pattern-making window (S910);

rotating each of the plurality of pattern-making layers on the pattern-making window (S920); and scaling each of the plurality of pattern-making layers on the pattern-making window (S930).

The step of visualizing (S700) may comprise steps of:

turning on or off each of the plurality of pattern-making layers on the pattern-making window;

dimming each of the plurality of pattern-making layers on the pattern-making window; and darkening each of the plurality of pattern-making layers on the pattern-making window.

The method may further comprise a step of storing the first panel in a panel computer file.

The method may further comprise a step of providing a second panel comprising a plurality of panel points and lines defined on the textile coordinate system, wherein the plurality of panel points and lines form a closed boundary.

The method may further comprise a step of providing a plurality of second pattern-making layers associated with the second panel, each of which comprising a plurality of pattern-making points and lines, wherein the plurality of pattern-making points and lines form a pattern.

Each of the first and second panel may be configured to represent a cloth piece.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A method for creating panels for a garment using a textile coordinate system in a digital clothing comprising steps of:

defining a horizontal axis on a pattern-making window;

defining a vertical axis on the pattern-making window;

defining an outward side on the pattern-making window toward an observer in front of the pattern-making window;

forming the textile coordinate system defined by the horizontal axis and the vertical axis on the outward side of the pattern-making window;

providing a first panel comprising a plurality of panel points and lines on a panel layer defined on the textile coordinate system, wherein the plurality of panel points and lines form a closed boundary;

providing a plurality of first pattern-making layers associated with the first panel, each of which comprising a plurality of pattern-making points and lines, wherein the plurality of pattern-making points and lines form a pattern;

visualizing the first panel and at least one of the plurality of first pattern-making layers on the pattern making window, wherein the first panel is drawn on top of the first pattern-making layers;

storing the first panel having the plurality of panel points and lines in a panel computer file and the plurality of first pattern-making points and lines in a pattern-making computer file, turning on or off each of the plurality of pattern-making layers on the pattern-making window;

dimming each of the plurality of pattern-making layers on the pattern-making window; and darkening each of the plurality of pattern-making layers on the pattern-making window.

2. The method of claim 1, wherein the horizontal axis is along a warp direction of a textile roll.

3. The method of claim 2, wherein the vertical axis is along a weft direction of the textile roll.

4. The method of claim 1, further comprising a step of providing a first master panel comprising the first panel.

5. The method of claim 4, wherein the first master panel further comprises a seam allowance provided around the first panel.

6. The method of claim 5, wherein the first mater panel further comprises a plurality of master panel points and lines defining a master panel contour.

7. The method of claim 1, wherein the plurality of panel points and lines form a panel contour.

8. The method of claim 1, further comprising steps of:

translating each of the plurality of pattern-making layers on the pattern-making window;

rotating each of the plurality of pattern-making layers on the pattern-making window; and scaling each of the plurality of pattern-making layers on the pattern-making window.

9. The method of claim 1, further comprising a step of providing a second panel comprising a plurality of panel points and lines defined on the textile coordinate system, wherein the plurality of panel points and lines form a closed boundary.

10. The method of claim 9, further comprising a step of providing a plurality of second pattern-making layers associated with the second panel, each of which comprising a plurality of pattern-making points and lines, wherein the plurality of pattern-making points and lines form a pattern.

11. The method of claim 10, wherein each of the first and second panel is configured to represent a cloth piece.

* * * * *